US007318538B2

(12) United States Patent
Bichot

(10) Patent No.: US 7,318,538 B2
(45) Date of Patent: Jan. 15, 2008

(54) PERFUME DISPENSER PROVIDED WITH A PERFORABLE CARTRIDGE

(75) Inventor: Tiphaine Bichot, Paris (FR)

(73) Assignee: VII° Sens, Paris (FR)

( * ) Notice: Subject to any disclaimer, the term of this patent is extended or adjusted under 35 U.S.C. 154(b) by 0 days.

(21) Appl. No.: 10/522,814

(22) PCT Filed: Jul. 29, 2003

(86) PCT No.: PCT/FR03/02397

§ 371 (c)(1),
(2), (4) Date: Sep. 22, 2005

(87) PCT Pub. No.: WO2004/012777

PCT Pub. Date: Feb. 12, 2004

(65) Prior Publication Data

US 2006/0102660 A1 May 18, 2006

(30) Foreign Application Priority Data

Jul. 30, 2002 (FR) ..... 02 09700

(51) Int. Cl.
*B67D 5/00* (2006.01)

(52) U.S. Cl. ..... 222/82; 222/183; 222/321.7

(58) Field of Classification Search ..... 222/82, 222/83, 183, 131, 321.9, 321.7, 321.8; 277/910
See application file for complete search history.

(56) References Cited

U.S. PATENT DOCUMENTS

| | | | | |
|---|---|---|---|---|
| 5,273,189 A | | 12/1993 | Jouillat et al. | |
| 5,503,302 A | * | 4/1996 | DeJonge | 222/82 |
| 6,053,363 A | * | 4/2000 | Revenu | 222/82 |
| 6,145,703 A | * | 11/2000 | Opperman | 222/82 |

FOREIGN PATENT DOCUMENTS

| | | |
|---|---|---|
| EP | 0 251 939 | 1/1988 |
| FR | 2 537 093 | 6/1984 |
| FR | 2 682 019 | 4/1993 |
| WO | WO 97/06842 | 2/1997 |

* cited by examiner

*Primary Examiner*—Kevin Shaver
*Assistant Examiner*—Stephanie E. Tyler
(74) *Attorney, Agent, or Firm*—Young & Thompson

(57) ABSTRACT

The perfume dispenser (1) includes a container (3) containing a perfume, a device (2) for pumping and atomizing the perfume, a pump and a tube (16) for drawing off the perfume. The first end (18) of the tube is connected to the pump, the second end (20) thereof being arranged in the bottom of the container (3) which includes a region perforable by the tube (16) embodied in the form of a perforation unit.

11 Claims, 2 Drawing Sheets

PERFUME DISPENSER PROVIDED WITH A PERFORABLE CARTRIDGE

The present invention relates to a perfume dispenser of the type comprising:

a container containing perfume, a device for pumping and atomizing the perfume, the device comprising an atomizer, a pump and a tube for drawing off the perfume, the tube comprising a first end connected to the pump and a second end which is to be arranged in the bottom of the container.

Such dispensers are generally bulky and cannot be placed and kept in the pocket of an item of clothing.

In addition, in order to refill such dispensers, the container is generally filled with a vial containing perfume. Such an operation proves to be tricky to implement and may lead to some of the perfume being spilt and lost.

Dispensers of the above-mentioned type that are accommodated in presentation cases are also known.

When the container is empty, the whole of the dispenser inside the presentation case is replaced. Thus, refilling with perfume proves to be particularly expensive.

An object of the invention is to solve this problem by providing a dispenser of the above-mentioned type which can have small dimensions and which can be refilled readily and economically.

To that end, the invention relates to a dispenser of the above-mentioned type, characterized in that the container comprises a perforable region and the tube forms a member for perforating the perforable region.

According to particular embodiments, the dispenser may comprise one or more of the following features, taken in isolation, or in accordance with any technically possible combination:

the tube comprises metal, at least at its second end;

the perforable region is a disc delimited in the container by a region of lesser resistance;

the container is composed of plastics material;

the container is force-fitted in the pumping and atomizing device in order to be held relative thereto.

The invention relates also to a container for a dispenser such as defined above, characterized in that it comprises a perforable region.

According to variants:

the perforable region is a disc delimited in the container by a region of lesser resistance; and the container is composed of plastics material.

The invention relates also to a pumping and atomizing device for a dispenser such as defined above, characterized in that the draw-off tube forms a member for perforating a perforable region of a container.

According to one variant, the draw-off tube comprises metal, at least at its second end.

The invention will be better understood on reading the following description which is given purely by way of example and with reference to the drawings, in which:

FIG. 1 illustrates a perfume dispenser 1 which comprises:

Figure 1:
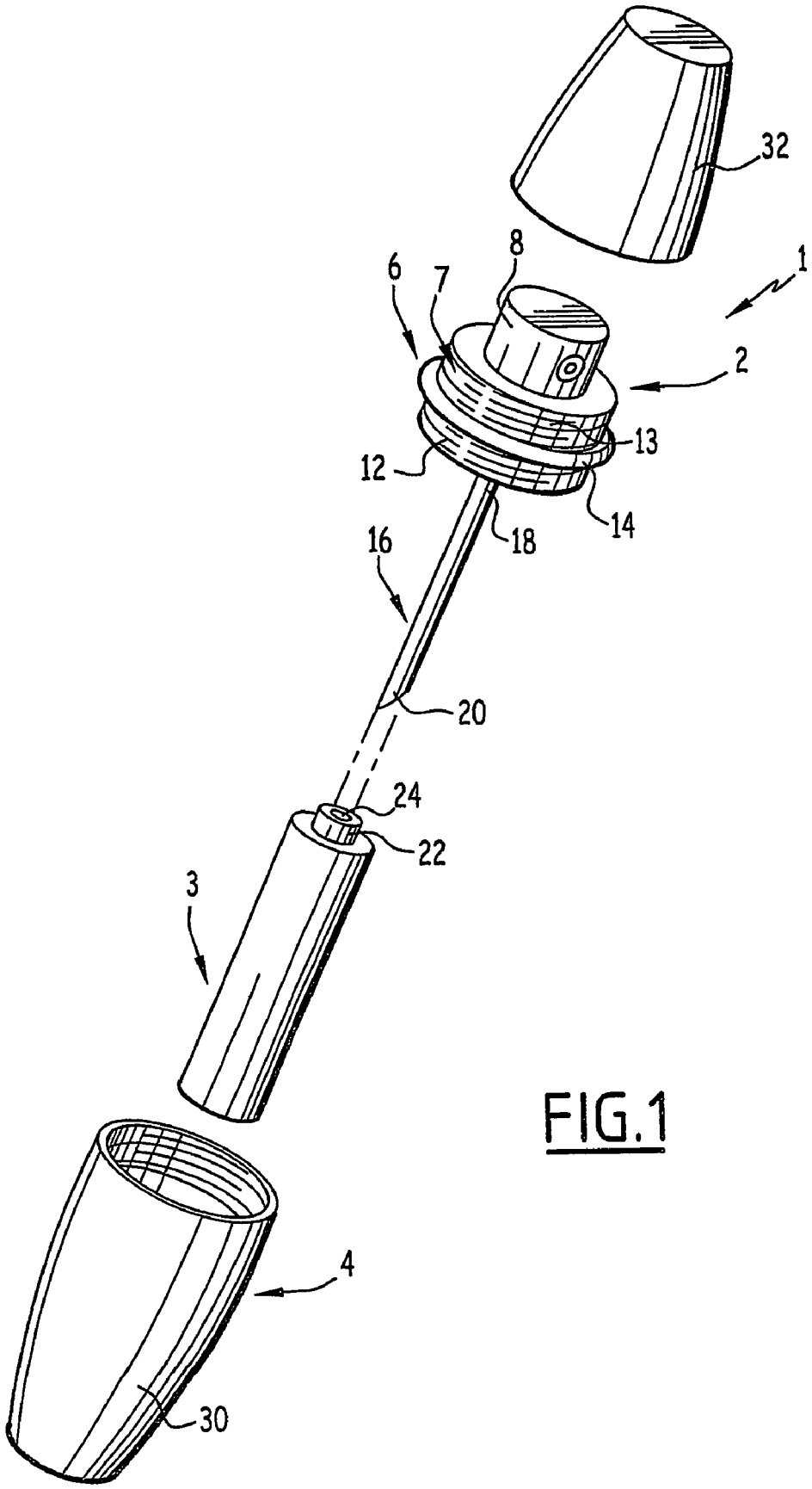
FIG. 1 is an exploded diagrammatic perspective view of a dispenser according to the invention.

a pumping and atomizing device 2;

a container 3 containing perfume, and a case 4.

The device 2 comprises a plug 6 comprising a pump and an atomizer. The plug 6 comprises a fixed body 7 and a mobile push-button 8 for manual operation of the pump in order to bring about the suction of the perfume and its atomization. Such a plug 6 is conventional and the structure of its pump and its atomizer will therefore not be described in more detail.

The lateral wall of the body 7 of the plug 6 comprises a threaded lower section 12, a threaded upper section 13 and a projecting bead 14 separating the sections 12 and 13.

The device 2 also comprises a tube 16 for drawing off the perfume, whose upper end 18 is connected to the inlet of the pump and whose bevelled lower end 20 is to be located in the bottom of the container 3.

The tube 16 is composed of metal.

The container 3 is a cartridge which is composed of plastics material and which has a vertically elongated substantially cylindrical shape. The container 3 comprises at its upper end an annular neck 22 delimiting a circular opening 24 for the passage of the draw-off tube 16.

Figure 3:
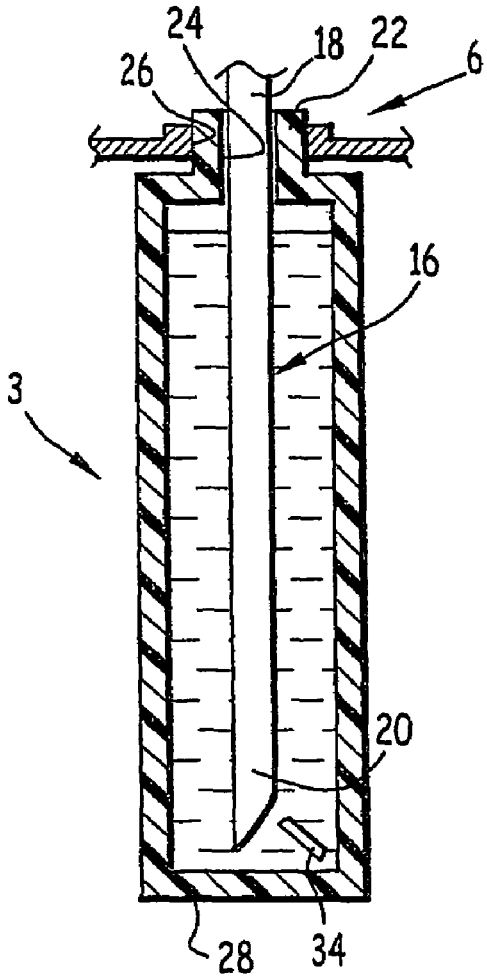

As illustrated by FIG. 3, the neck 22 is received in a circular housing 26 provided in the lower wall of the body 7 of the plug 6.

The neck 22 has an outside diameter which is initially slightly larger than the inside diameter of the housing 26. The housing 26 therefore receives the neck 22 with a press fit, thus ensuring that the container 3 is held vertically relative to the plug 6.

The lower end 20 of the tube 16 is then located in the vicinity of the bottom 28 of the container 3.

The case 4 comprises a lower portion 30 whose upper end is tapped in order to be screwed onto the lower section 12 of the body 7, and an upper portion 32 forming a cap whose lower end is also tapped in order to be screwed onto the upper section 13 of the body 7.

The opening 24 for the passage of the tube 16 has been formed in the container 3 by pressing in a disc 34 connected to the neck 22 by an annular region 36 of lesser resistance. This is illustrated by FIGS. 2 and 3.

Figure 2:
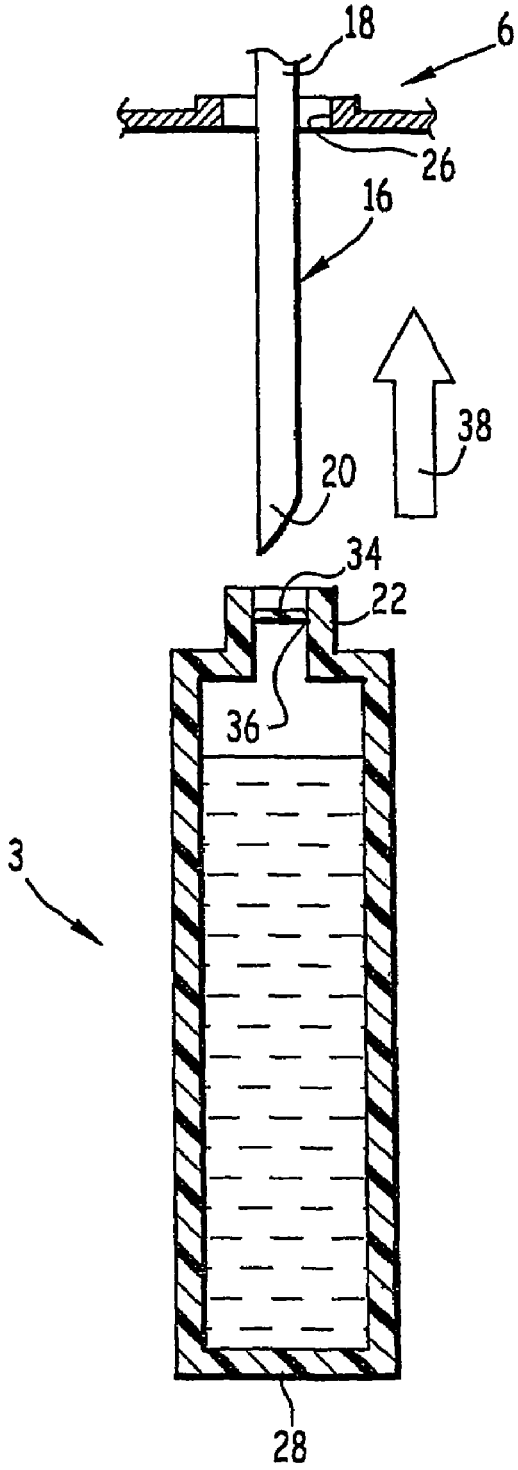
FIGS. 2 and 3 are partial and diagrammatic sections illustrating the coupling of the container and the pumping and atomizing device of the dispenser.

To be more precise, in order to couple the container 3 to the pumping and atomizing device 2, the container 3 has been displaced upwards relative to the device 2 as symbolized by the arrow 38 in FIG. 2.

In the course of that movement, the lower end 20 of the tube 16 has borne on the disc 34 and caused the region 36 of lesser resistance to break. The disc 34 has then been pressed into the container 3. The movement of the container 3 has been terminated by the fitting, with slight force, of the neck 22 of the container 3 in the housing 26 of the plug 6. In the course of this fitting operation, the neck 22 has become resiliently deformed.

It will be noted that the pressing-in of the disc 34 has been achieved owing to the fact that the tube 16 composed of metal is sufficiently rigid.

When the portions 30 and 32 of the case 4 are screwed onto the plug 6, the dispenser 1 is substantially in the form of a lipstick case. The push-button 8 and the container 3 are therefore masked.

The dispenser 1 then has a height lower than 11 cm and a width smaller than 4 cm.

The small dimensions and the low mass of the dispenser 1 enable it to be placed and kept in a pocket or in a small bag. The dispenser 1 is therefore particularly suitable for travel.

When it is desired to use the dispenser 1, the upper portion 32 of the case 4 is unscrewed and then the push-button 8 is operated in a conventional manner.

When the container 3 is empty, the lower portion 30 of the case 4 is unscrewed relative to the plug 6.

The empty container 3 is then withdrawn by displacing it downwards, and it is then replaced by a full new container 3, as described above with reference to FIGS. 2 and 3.

Such an operation of replacing the container 3 and therefore refilling the dispenser 1 proves to be particularly simple to implement and does not involve any risk of spilling perfume. In addition, the cost associated with refilling the dispenser 1 is low.

Furthermore, the dispenser 1 is light and is inexpensive to manufacture.

In a variant which is not shown, it is possible for only the lower end 20 of the tube 16 to be composed of metal.

In yet another variant, the lower end 20 may be pointed to form a needle for piercing the container 3. In that case, the disc 34 is not necessarily connected to the rest of the container 3 by a region 36 of lesser resistance.

Indeed, the mere fact of producing the container 3 from a low-resistance material, such as a plastics material, enables the disc 34 to be pierced by the lower end 20 of the tube 16.

In general, the case 4 and the container may be in forms other than those shown in FIG. 1.

The invention claimed is:

1. Perfume dispenser (1) comprising:

a container (3) containing perfume, a device (2) for pumping and atomizing the perfume, the device comprising an atomizer, a pump and a tube (16) for drawing off the perfume, the tube comprising a first end (18) connected to the pump and a second end which is to be arranged in the bottom (28) of the container (3) in order to draw off the perfume, the container (3) comprising a perforable region (34) and the second end of the tube (16) forming a member for perforating the perforable region (34), wherein the container is force-fitted in the pumping and atomizing device in order to be held relative thereto, the container comprising a neck, which is received with a press fit into a housing of the device, the neck having an outside diameter which is initially slightly larger than the inside of the housing.

2. Dispenser according to claim 1, wherein the tube (16) comprises metal, at least at its second end (20).

3. Dispenser according to claim 1, wherein the perforable region (34) is a disc delimited in the container (3) by a region (36) of lesser resistance.

4. Dispenser according to claim 1, wherein the container (3) is composed of plastics material.

5. Dispenser according to claim 1, which further comprises a case (4).

6. Dispenser according to claim 1, wherein (3) is replaceable.

7. Container for a dispenser according to claim 1, which contains perfume and comprises a perforable region (34).

8. Container (3) according to claim 7, wherein the perforable region (34) is a disc delimited in the container (3) by a region (36) of lesser resistance.

9. Container according to claim 1, which is composed of plastics material.

10. Dispenser according to claim 2, wherein the perforable region (34) is a disc delimited in the container (3) by a region (36) of lesser resistance.

11. Container according to claim 7, which is composed of plastics material.

* * * * *